United States Patent [19]

Baumann

[11] Patent Number: 4,497,859

[45] Date of Patent: Feb. 5, 1985

[54] INSULATING INSERT FOR STORAGE OR TRANSPORTATION CONTAINER

[75] Inventor: Hansjörg W. Baumann, Mühlau, Switzerland

[73] Assignee: Lonza Ltd., Gampel, Switzerland

[21] Appl. No.: 541,903

[22] Filed: Oct. 14, 1983

[30] Foreign Application Priority Data

Nov. 26, 1982 [CH] Switzerland ..... 6885/82

[51] Int. Cl.[3] ..... E04B 1/74

[52] U.S. Cl. ..... 428/71; 52/404; 206/523; 220/448; 220/902

[58] Field of Search ..... 206/523; 215/12 A, 13 R; 150/52 R; 220/448, 902; 52/404; 428/12, 71, 100, 542.8

[56] References Cited

U.S. PATENT DOCUMENTS

| | | | |
|---|---|---|---|
| 2,974,814 | 3/1961 | Parson et al. | 215/13 |
| 2,979,246 | 4/1961 | Liebeskind | 428/542.8 X |
| 3,157,303 | 11/1964 | Siegel | 150/52 R X |

*Primary Examiner*—Henry F. Epstein
*Attorney, Agent, or Firm*—Fisher, Christen & Sabol

[57] ABSTRACT

Mobile and collapsible insulating insert for storage and transportation containers. The insert has a hood which has connected outside surfaces made of non-foamed, flexible material. The mass and contours thereof correspond to the inside surfaces of the container. The outside surfaces are provided with pockets of non-foamed, flexible material, projecting into the inside of the hood, disposed closely one beside the other and extending over the length of the outside surfaces. The pockets are filled tightly and alternatingly with an open-celled foam plastic and a closed foam plastic. The hood has a releasable closing arrangement, which permits the temporary connection of at least one of the outside surfaces of the hood with the adjacently located outside surfaces of an insulating bottom plate. A fluid-tight bottom trough is attached between the bottom of the storage and transportation container and the bottom plate of the insulating insert.

2 Claims, 6 Drawing Figures

INSULATING INSERT FOR STORAGE OR TRANSPORTATION CONTAINER

BACKGROUND OF THE INVENTION

1. Field of the Invention

The invention relates to mobile and collapsible insulating inserts for storage and transportation containers.

2. Prior Art

Goods which are sensitive to changes in temperature are often shipped in refrigerated containers. Such refrigerated containers are produced according to the sandwich construction method and, in most cases, the wall thereof have a core of polyurethane foam between an outside and inside lamination of reinforced polyester. Such containers are relatively heavy and expensive. The large weight of the container is a disadvantage, especially as an air freight container.

BROAD DESCRIPTION OF THE INVENTION

An object of the invention is to provide an insulating insert, which permits the conversion in a simple manner of ordinary storage and transportation containers, such as made of aluminum, into insulating containers. Other objects and advantages of the invention are set out herein or are obvious herefrom to one ordinarily skilled in the art.

The objects and advantages of this invention are achieved by the insulating insert of the invention.

The invention involves an insulating insert which includes a hood which is composed of connected outside surfaces of non-foamed, flexible material. The mass and contours thereof correspond to the inside surfaces of the container. The outside surfaces have pockets of non-foamed, flexible material, projecting into the inside of the hood, arranged closely side by side, and projecting beyond the length of the outside surfaces. The pockets are filled tightly and alternatingly always with a core made of open-celled foam plastic and closed foam plastic. The hood has a releasable closing arrangement, which permits the temporary connection of at least one of the outside surfaces thereof with the adjacent outside surfaces of an insulating bottom plate. A fluid-tight bottom trough is attached between the bottom of the storage and transport container and the bottom plate of the insulating insert.

Effectively plastic foils and preferably PVC-coated polyester material are used as the non-foamed, flexible material for the outside surfaces and pockets. Preferably a material is used which has a weight per unit area of 500 to 800 g/m$^2$.

The pockets can be attached to the outside surfaces by being sewed on or welded on. The size of the pockets can be adjusted to the dimensions of the storage or transportation containers, whereby the effective width for a closed-wall cell core shall not be less than 250 mm, for an open cell core not less than 120 mm and in both cases not more than 1000 mm. The pockets are filled tightly and alternatingly with cores of open cell foam plastic and cores of closed-wall cell foam plastic. As a result of this tight filling, especially of the open cell core of foam plastic, the individual pockets are pressed tightly against one another and the interval between the pockets, which is conditioned as a result of the production, is practically filled in. As a result of that, so-called heat-bridges are avoided.

Polyurethane foam or polyester fleeces are effectively used as the open-cell material. Polyolefin or polyvinylchloride foam is effectively used as the closed-cell material.

The locking arrangement, which permits the connection of one of the outside surfaces of the hood with the adjacent outside surfaces of the bottom plate and thus achieves a closed system, effectively is composed of zippers or so-called "burr closures."

The bottom of the insulating insert is composed of a bottom plate. The latter is preferably composed of an insulated and statically chargeable plate, effectively composed of a sandwich construction with cover layers of a lightly foamed plastic plate and having, as a core, a semi-hard or hard foam substance insulation of less than 100 kg/m$^3$ bulk density. The load absorbing side of the sandwich plate is provided, for the purpose of ensuring sufficient cooling in the lower part of the freight inserted into the container, with ribs or lightly foamed plastic plate material, 10 to 15 mm high and about 100 mm wide. The surface of the load-side has a glass-fiber reinforced plastic coating.

Between the container bottom and the bottom of the insulating insert, there is a water-tight bottom trough made of flexible non-foamed plastic or of coated fabric. The bottom trough can be connected fixedly with the bottom of the insulating container. The trough can be used for reception of the folded up insulating container and the subsequently described bottom plate.

Furthermore, a sleeve-like trough can be attached in suspension on the roof side for the storing of dry ice. The perforated lower part of this trough can be fully or partially covered up with flaps for the purpose of controlling the degree of cold. Additional dry ice can be inserted into the suspended trough when needed through a closable opening located at the front side.

The insulating insert is attached in the inside of the storage and transportation container by mechanical attachment, for example, by means of screws. This mechanical attachment can be simply removed so that the storage and transportation container, depending on the purpose of its use, can be used as a simple storage and transportation container or, equipped with the insulating insert, as a cool storage and cool transportation container.

DETAILED DESCRIPTION OF THE INVENTION

Figure 1:
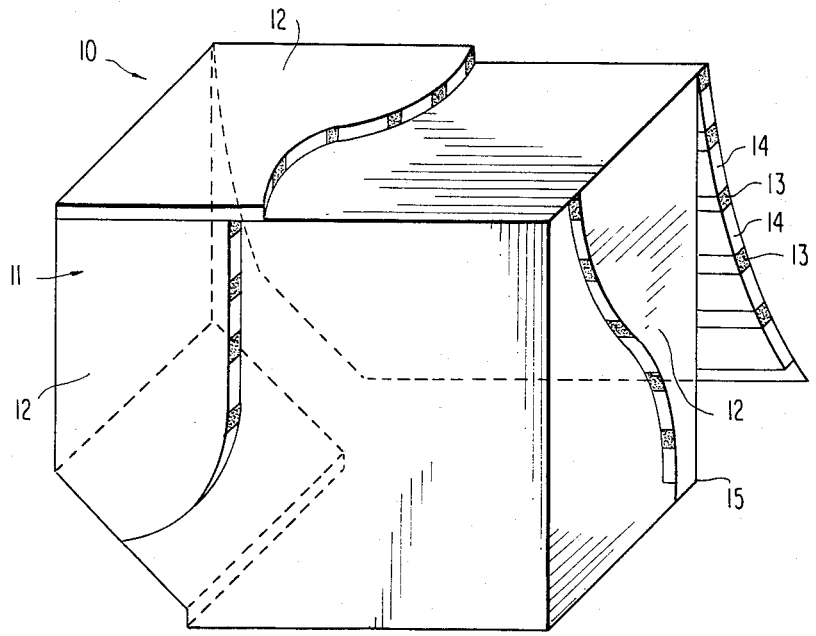
FIG. 1 is a partially-cutaway perspective view of the insulating insert of the invention with one side of the hood partially lifted.
Figure 2:
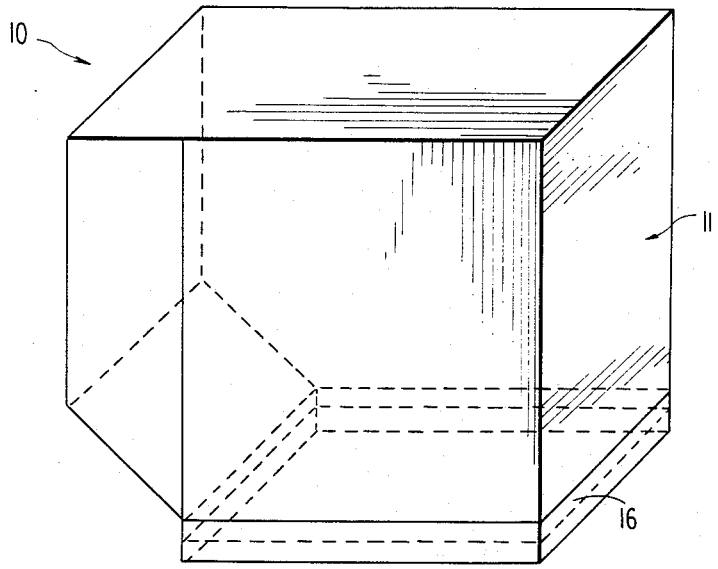
FIG. 2 is a perspective view of the insulating insert of the invention.
Figure 3:
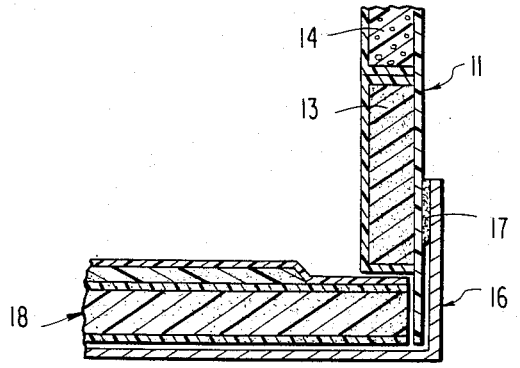
FIG. 3 is a side cross-sectional view of part of the side and bottom of the insulating insert of the invention.
Figure 4:
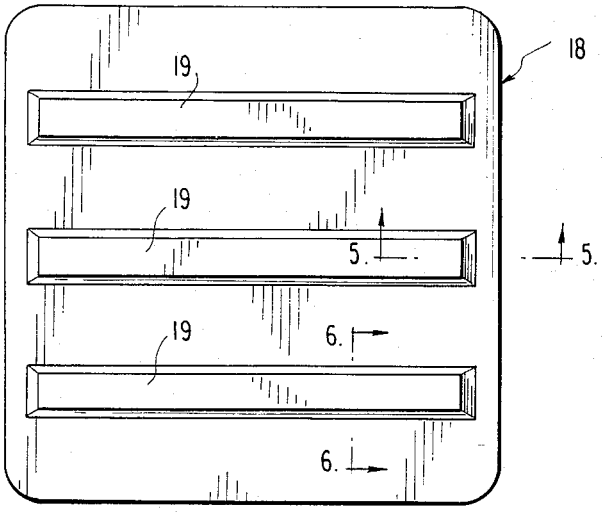
FIG. 4 is a top view of the bottom plate of the insulating insert of the invention.
Figure 5:
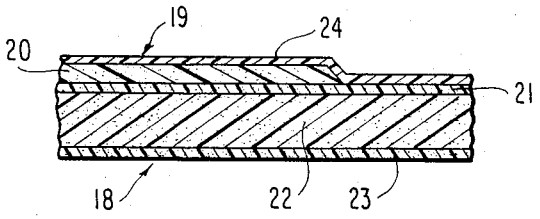
FIG. 5 is a cross-sectional view along line 5—5 in FIG. 4.
Figure 6:
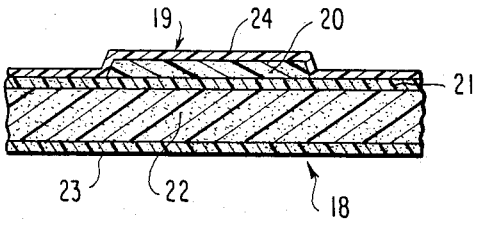
FIG. 6 is a cross-sectional view along line 6—6 in FIG. 4.

In FIG. 1, hood 11 of insulating insert 10 is composed of outside surfaces 12 which has pockets 13 and 14, that are alternatingly filled with open-cell and closed-cell foam plastic. Numeral 15 represents the closing arrangement, in this case developed as a burr closure, by which the outside surfaces are connected with one another. In FIG. 2, the hood of insulating insert 10 is schematically represented only as indicated by numeral 11. Numeral 16 represents the bottom trough. As shown in FIG. 3, hood 11 is attached to bottom trough 16 by means of burr-closure 17. Numeral 18 represents the insulating bottom plate. FIG. 4 shows bottom plate 18 and ribs 19 thereof. Ribs 19 are composed of lightly foamed plastic 20 which are mounted on to support 21 made of lightly foamed plastic. An insulating foam substance with a bulk density of less than 100 kg/m$^3$ serves as insulating material 22. The end of bottom trough 16 is composed of plate 23 of lightly foamed plastic. Cover layer 24 of glass fiber reinforced plastic is attached in an upwards direction toward the insulating space.

By way of summary, the invention involves a mobile or portable insulating insert for storage and transportation containers, which permits the conversion of ordinary storage and transportation containers into insulating containers in a simple manner. The insulating insert is composed of a hood made of flexible material, with foam plastic inserted into the pockets thereof, an insulating bottom plate and a fluid-tight bottom trough.

What is claimed is:

1. Mobile and collapsible insulating insert for a storage and transportation container, consisting of (i) a hood, which consists of connected outside surfaces made of non-foamed, flexible material, the mass and contours of which correspond to the inside surfaces of the container, and which is provided with pockets of non-foamed, flexible material, projecting into the inside of the hood, disposed closely one beside the other, and extending over the length of the outside surfaces, said pockets being filled tightly and alternatingly with open-celled foam plastic cores and closed foam plastic cores, and which has a releasable closing arrangement, which permits connection temporarily of at least one of the outside surfaces to the adjacently-located outside surfaces of (ii) an insulating bottom plate and (iii) a fluid-tight bottom trough, which is attached between the bottom of the storage and transportation container and the bottom plate of the insulating insert.

2. Mobile and collapsible insulating insert as claimed in claim 1 wherein the bottom plate consists of a plate which is formed in sandwich construction with a cover layer of lightly foamed plastic and a core of hard plastic foam and the top side of which has a coating of glass fiber-reinforced plastic.

* * * * *